US009032573B2

(12) United States Patent
Mijan

(10) Patent No.: US 9,032,573 B2
(45) Date of Patent: May 19, 2015

(54) BED VIBRATION SYSTEM AND METHOD

(76) Inventor: David Mijan, Ma'ale Adumim (IL)

( * ) Notice: Subject to any disclaimer, the term of this patent is extended or adjusted under 35 U.S.C. 154(b) by 0 days.

(21) Appl. No.: 14/009,171

(22) PCT Filed: May 30, 2012

(86) PCT No.: PCT/IL2012/000209

§ 371 (c)(1),
(2), (4) Date: Oct. 1, 2013

(87) PCT Pub. No.: WO2012/164554

PCT Pub. Date: Dec. 6, 2012

(65) Prior Publication Data

US 2014/0189957 A1 Jul. 10, 2014

Related U.S. Application Data

(60) Provisional application No. 61/491,909, filed on Jun. 1, 2011.

(51) Int. Cl.

| | |
|---|---|
| ***A47C 21/00*** | (2006.01) |
| ***A47D 9/02*** | (2006.01) |
| ***B06B 1/16*** | (2006.01) |

(52) U.S. Cl.

CPC ..... *A47C 21/006* (2013.01); *Y10T 74/18552* (2015.01); *Y10T 29/49716* (2015.01); *A47D 9/02* (2013.01); *B06B 1/16* (2013.01)

(58) Field of Classification Search

CPC ..... A61H 2201/0142; A61H 1/005; A47C 21/006; A47D 9/02; B06B 1/16

USPC ..... 5/105, 108, 109, 915; 601/49, 50, 53, 601/59, 60, 70, 82, 86, 90, 98, 103

See application file for complete search history.

(56) References Cited

U.S. PATENT DOCUMENTS

| | | | | |
|---|---|---|---|---|
| 2,198,910 A | | 4/1940 | Everett | |
| 2,668,530 A | * | 2/1954 | Tackaberry | 601/60 |
| 2,908,271 A | * | 10/1959 | Ware | 601/50 |
| 2,953,128 A | | 9/1960 | Searl | |
| 3,503,389 A | * | 3/1970 | McKee et al. | 601/60 |
| 3,732,860 A | | 5/1973 | Thurmer | |

(Continued)

FOREIGN PATENT DOCUMENTS

| | | | | |
|---|---|---|---|---|
| EP | 1034770 | | 9/2000 | |
| EP | 2198910 A1 | * | 6/2010 | A61M 21/00 |

OTHER PUBLICATIONS

International Search Report dated Oct. 2, 2012 in corresponding International Application No. PCT/IL2012/000209.

(Continued)

*Primary Examiner* — Michael Trettel

(74) *Attorney, Agent, or Firm* — S. Yarus; IP Attitude Ltd.

(57) ABSTRACT

A bed vibration system to provide controllable vibrations beneath a mattress, which is located on a bed, the system comprising: a frame attachable to the bed by at least four suspension modules; at least two vibration modules, each vibration module having a rotatable element; at least two travel tracks attachable to the frame, the travel tracks configurable to have the at least two vibration modules respectively displaceable thereupon; and a vibration module control unit configurable to control vibrations and displacement of the respective vibration modules.

18 Claims, 10 Drawing Sheets

Detail "A"

(56) References Cited

U.S. PATENT DOCUMENTS

| | | | | |
|---|---|---|---|---|
| 3,762,402 | A * | 10/1973 | Abramovitz | 601/65 |
| 3,882,556 | A | 5/1975 | Accurso | |
| 4,934,997 | A * | 6/1990 | Skakas | 600/26 |
| 5,020,518 | A | 6/1991 | Spears | |
| 6,647,572 | B2 | 11/2003 | Lee | |
| 6,682,495 | B2 | 1/2004 | Park | |
| 7,111,346 | B2 * | 9/2006 | Inman et al. | 5/600 |
| 7,281,284 | B2 | 10/2007 | Sims | |
| 7,478,446 | B2 * | 1/2009 | Sims, Jr. | 5/607 |
| 2007/0208284 | A1 | 9/2007 | Huang | |
| 2008/0039044 | A1 | 2/2008 | Weng | |

OTHER PUBLICATIONS

European Search Report dated Oct. 1, 2014 in corresponding parallel EP Application 12793261.4 filed Nov. 21, 2013.

* cited by examiner

Detail "A"

Detail "B"

BED VIBRATION SYSTEM AND METHOD

This application claims priority from US Provisional Application No. 61/491,909, filed 1 Jun. 2011, whose disclosure is incorporated herein by reference.

FIELD AND BACKGROUND OF THE INVENTION

The current invention relates to the field of comfortable rest and sleep enhancement and specifically to a bed vibration system and method.

Some individuals have difficulty in resting and/or falling asleep. In some instances, a vibration-prone environment—such as but not limited to: mobile homes, automobile reclining; truck beds; and train reclining—may actually help a person to fall asleep. Background gentle vibrations—which may even be random and/or stronger at times, can help relax people and help them fall asleep. One well known example is when traveling with small children; the vibrations of a car seem to help children to fall asleep. Another example is the movement of a train in motion, which helps lull some people to sleep.

In the specification which follows herein, the term "recline" is intended to mean lying upon a surface which may be substantially horizontal, such as, but not limited to the manner in which people sleep in a bed. An additional meaning of the term "recline", as used herein, is any manner of resting, which may include positions ranging from sitting to lying.

Reference is presently made to FIG. 1, which is an isometric drawing of a prior art bed 5, used for reclining. Bed 5 has a base 8, upon which a mattress (not shown) is typically placed. The individual typically reclines on the mattress of bed 5. Prior art bed 5 is typically located in a building where there are typically no substantial background vibrations.

Active elements may be added to a bed to provide some vibrations. A number of prior art deal with the overall consideration noted above. Examples of prior art include the following.

U.S. Pat. No. 2,953,128, whose disclosure is incorporated herein by reference, in which Searl describes an improved vibrating device adapted to be readily and easily attached or detached from a bed. The device includes a relatively thin, flat horizontal member, adapted for insertion between the mattress and spring of a bed, and a vertical member connected to one end of the horizontal member and adapted to be detachably clamped to a side or end rail element of the bed frame.

Lee, Kwang-ho et al., in U.S. Pat. No. 6,647,572 whose disclosure is incorporated herein by reference, describes a cushion comprising a sponge having a predetermined length and a circular cylinder-shaped configuration; a plurality of vibrating motors embedded in the sponge; an inner envelope opened at one end thereof, for allowing the sponge to be inserted therein, with a predetermined space defined therebetween; cushioning segments filled into the space defined between the sponge and the inner envelope; a frame made of plastic material and fitted into the opened one end of the inner envelope to be brought at one end thereof into contact with the sponge, the frame having a cylindrical configuration; a rechargeable battery positioned in the frame and connected through electric wires to the vibrating motors; a frame cover fastened to the frame to close the other end of the frame; an aromatic case fixed to an inner surface of the frame cover to be positioned in the frame and receive therein an aromatic; an aromatic case cover attached to the frame cover and defined with a plurality of slots which are opened and closed by a plurality of sliding plates, respectively, so that an amount of the aromatic which is given out through the slots can be adjusted; and an outer envelope made of cloth and capable of being opened and closed at one end thereof, for enclosing the resultant combination.

In U.S. Pat. No. 6,682,495 whose disclosure is incorporated herein by reference, Park, Young-go et al. describe a vibrating bed comprising a basic bed having a bed frame, casters secured on the basic bed, a lateral vibrating bed plate movably ridden on the casters, a mechanism for reciprocally moving the vibrating bed plate with respect to the bed frame, a connecting rod adjusting device and tension coil springs for dampening the vibrations of the vibrating bed plate as the vibrating bed plate reaches a predetermined horizontal, or lateral, position.

Dewey, in U.S. Pat. No. 7,281,284, whose disclosure is incorporated herein by reference, describes variable motion rocking bed is provided that includes a first support structure including a first threaded rod having a first section threaded in a first direction and a second section threaded in a second direction, a second support structure including a second threaded rod having a first section threaded in a first direction and a second section threaded in a second direction, and a frame, the frame capable of being in a rocking motion with respect to the first support structure and the second support structure. The rocking bed further includes a first pair of linkage assemblies secured between the first support structure and the frame, and a second pair of linkage assemblies secured between the second support structure and the frame. The position of the first pair of linkage assemblies may be adjusted with respect to the first support structure and the position of the second pair of linkage assemblies may be adjusted with respect to the second support structure to change the shape of the rocking motion of the frame relative to the first support structure and the second support structure.

Whereas the prior art currently addresses vibrations in various configurations, the solutions are relatively complicated, large, and/or relatively expensive. There therefore exists a need to more simply and cheaply apply vibrations to a bed to enhance rest and sleep while the individual is reclining. Additionally, it is most advantageous for the system to be easily attached and detached from the bed.

SUMMARY OF THE INVENTION

According to the teachings of the present invention there is provided a bed vibration system to provide controllable vibrations beneath a mattress, which is located on a bed, the system comprising: a frame attachable to the bed by at least four suspension modules; at least two vibration modules, each vibration module having a rotatable element; at least two travel tracks attachable to the frame, the travel tracks configurable to have the at least two vibration modules respectively displaceable thereupon; and a vibration module control unit configurable to control vibrations and displacement of the respective vibration modules. Preferably, the at least two vibration modules each further comprise: a vibration motor having a shaft, a rider supporting the motor and the rider having at least two wheels mountable on the travel tracks, and a rotatable eccentric weight mountable onto the shaft. Most preferably, the vibration motor is operatable to rotate the eccentric weight. Typically, rotation of the eccentric weight serves to vibrate the vibration module and to provide force to displace the vibration module. Most typically, the bed vibration system is retrofittable to a bed. Preferably, the suspension modules have a ball-in-socket configuration.

According to the teachings of the present invention there is further provided a method of retrofitting a bed vibration system to provide controllable vibrations beneath a mattress, which is located on a bed, the method comprising the steps of: attaching a frame to the bed by at least four suspension modules; providing at least two vibration modules, each vibration module having a rotatable element; attaching at least two travel tracks to the frame, the travel tracks configured to have the at least two vibration modules respectively displaceable thereupon; and configuring a vibration module control unit to control vibrations and displacement of the respective vibration modules. Preferably, the at least two vibration modules each further comprise: a vibration motor having a shaft, a rider supporting the motor and the rider having at least two wheels mounted on the travel tracks, and a rotatable eccentric weight mounted onto the shaft. Most preferably, the vibration motor is operated to rotate the eccentric weight. Typically, rotation of the eccentric weight serves to vibrate the vibration module and to provide force to displace the vibration module.

BRIEF DESCRIPTION OF THE DRAWINGS

The invention is herein described, by way of example only, with reference to the accompanying drawings, wherein.

DETAILED DESCRIPTION OF THE PREFERRED EMBODIMENTS

Figure 1:
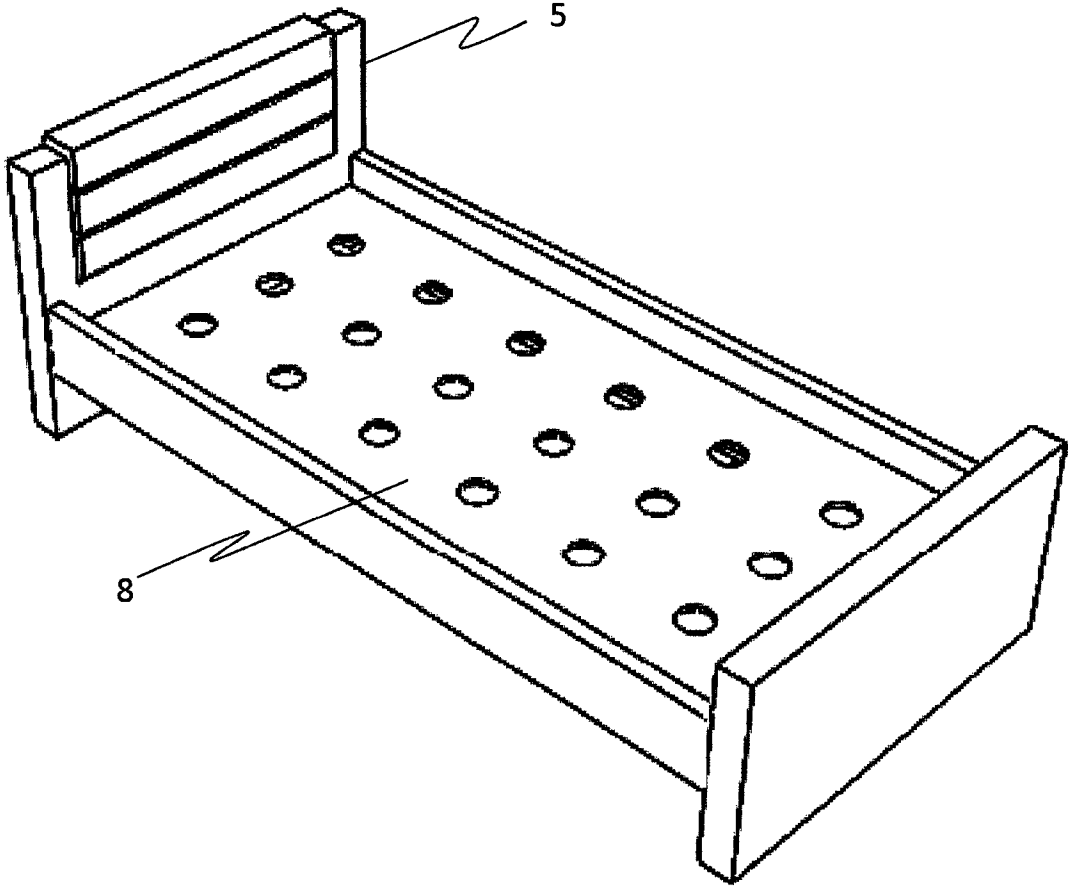
PRIOR ART FIG 1
FIG. 1 is an isometric drawing of a prior art bed, used for reclining.
Figure 2A:
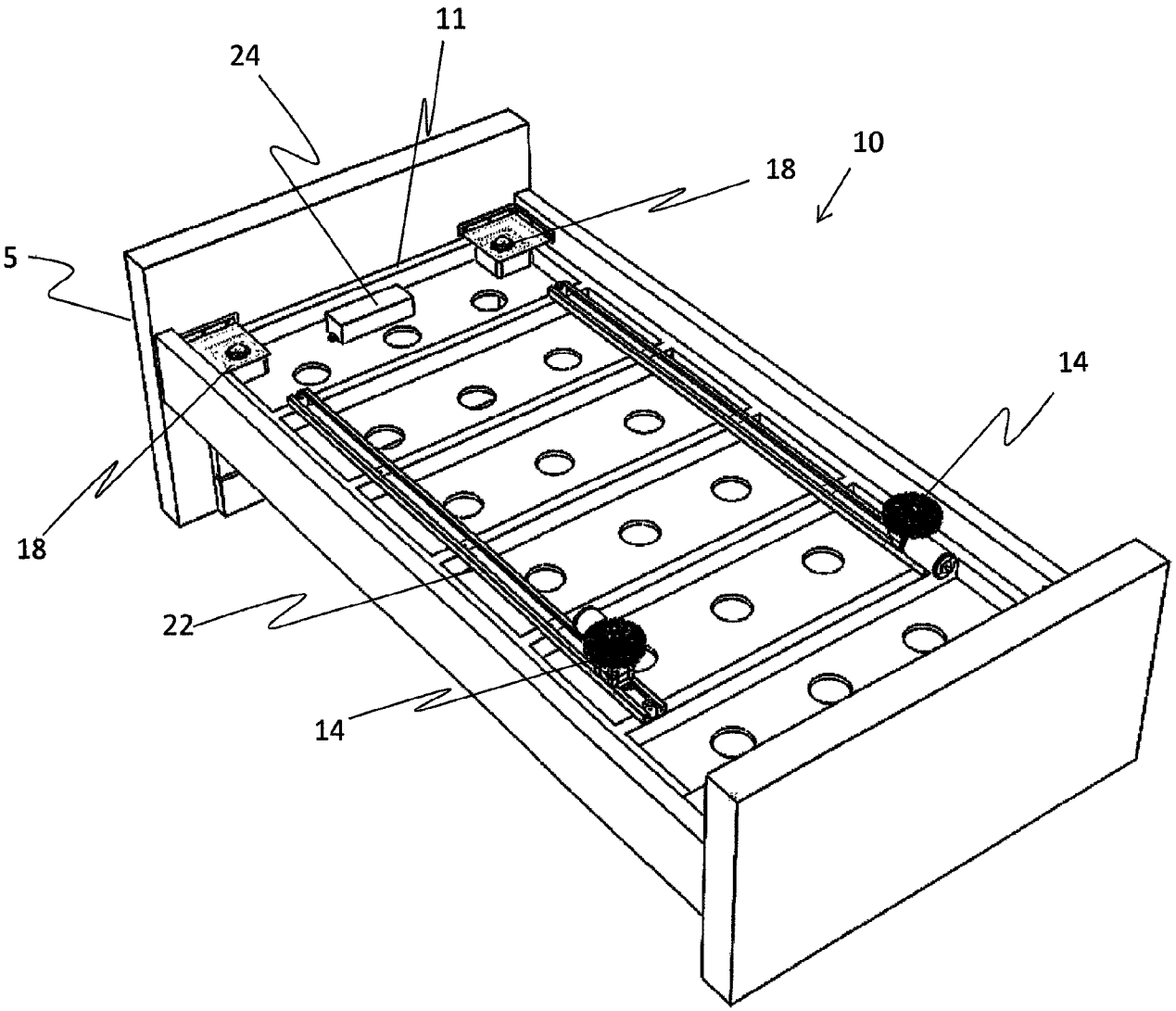
FIGS. 2A and 2B are an isometric view and elevation view, respectively, of the bed of FIG. 1 and of a bed vibration system, in accordance with an embodiment of the current invention.
Figure 2B:
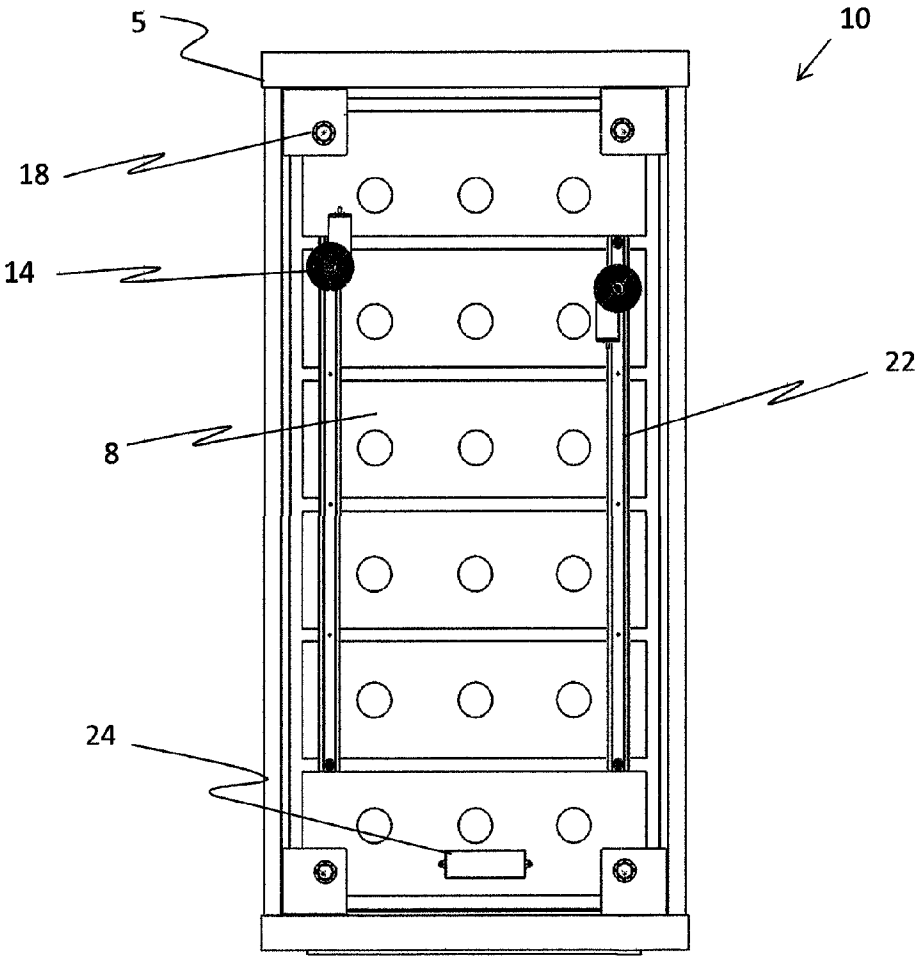

Reference is presently made to FIGS. 2A and 2B, which are an isometric view and elevation view, respectively, of the bed of FIG. 1 and of a bed vibration system 10, in accordance with an embodiment of the current invention. Bed vibration system 10 comprises a supporting frame 11, at least two vibration modules 14, at least 4 ball-and-socket suspension modules 18, two travel tracks 22, and a vibration module control unit 24. Supporting frame 11 is mechanically fixed to the base of the bed and the supporting frame serves to support the travel tracks as described hereinbelow. Two vibration modules 14 are free to run along travel tracks 22, which are mounted onto the supporting frame, as further described hereinbelow. Vibration module control unit 24 serves to control the vibration modules, in addition to providing both feedback and power (elements of which are not shown in the figures).

A mattress and/or additional support (not shown in the figures) are placed upon the bed vibration system, with sufficient clearance to allow the vibration modules to run along the travel tracks freely. The ball-and-socket suspension modules 18 are fabricated to attach the vibration system to base 8 to bed 5. The ball-and-socket modules serve to significantly reduce vibrations transferable from and to supporting frame 11 and bed 5, as further described hereinbelow.

Figure 3:
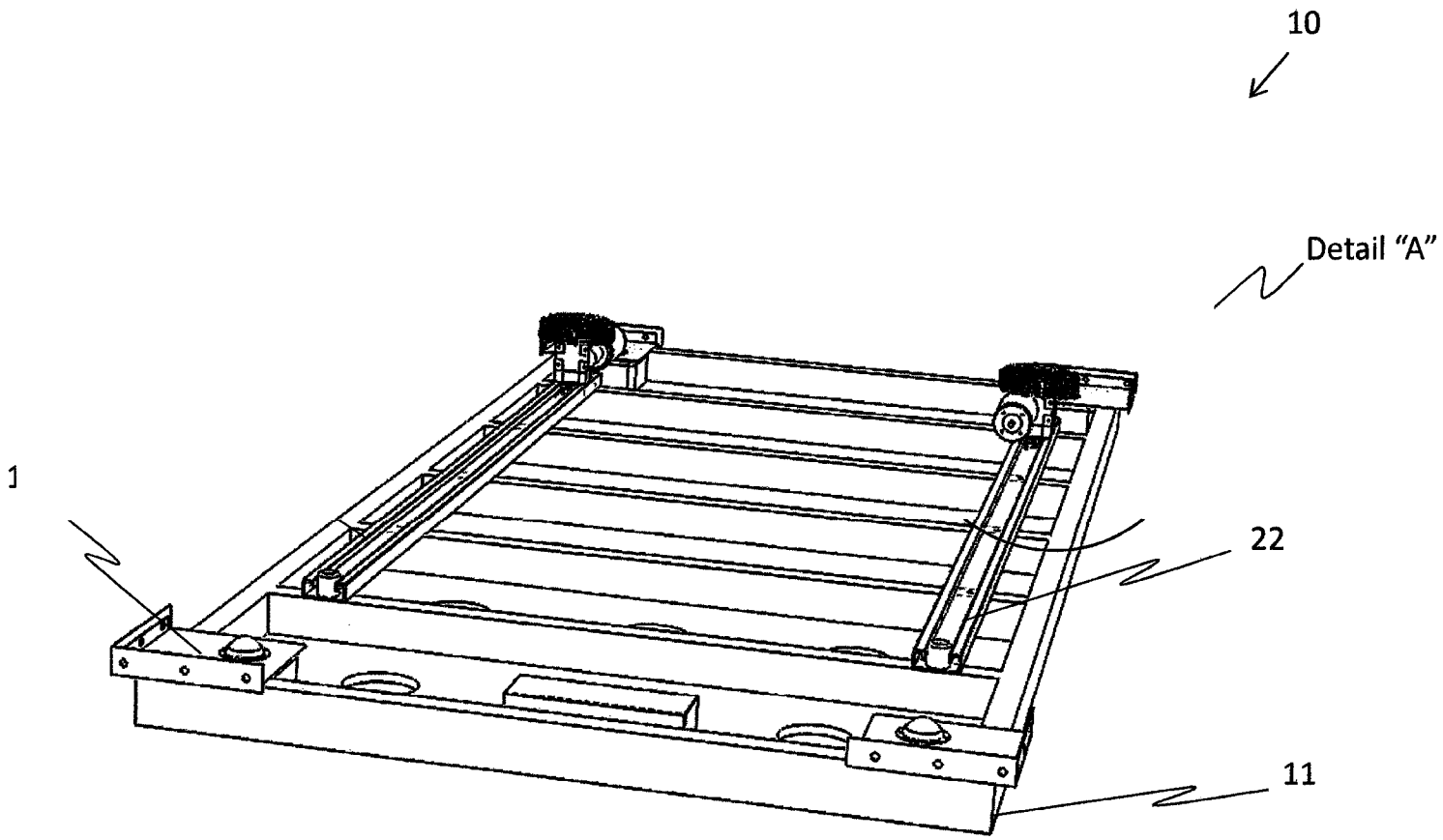
FIG. 3 is an isometric representation of a base and the bed vibration system from FIGS. 2A and 2B, in accordance with an embodiment of the current invention.
Figure 4A:
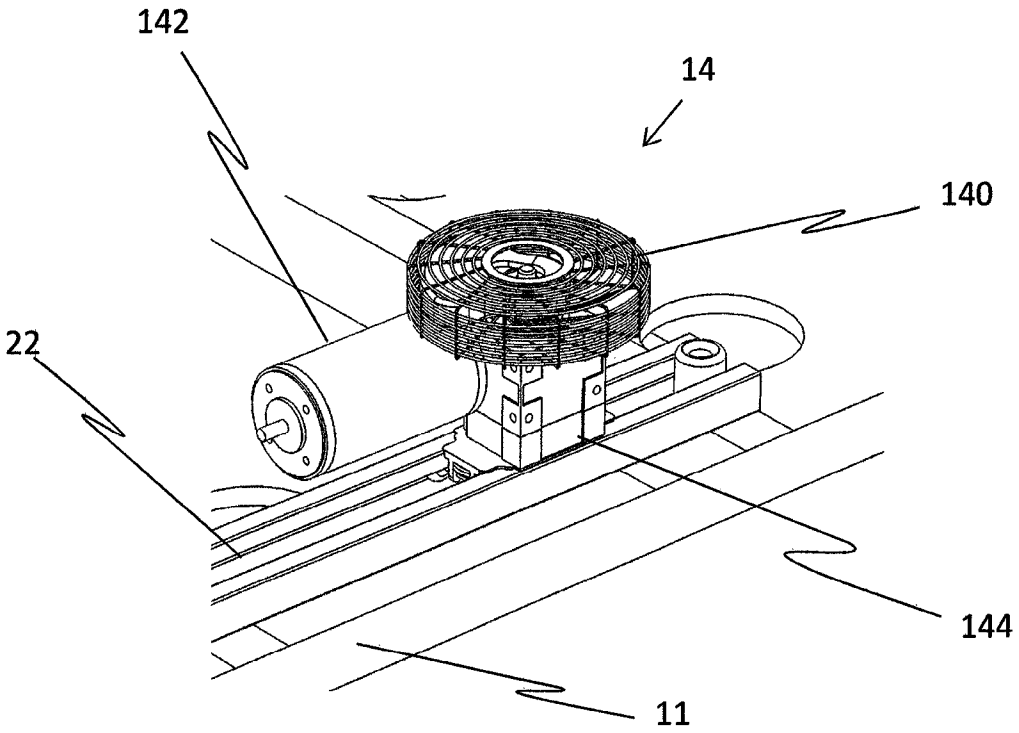
FIGS. 4A-D are isometric representations of a vibration module, in accordance with an embodiment of the current invention.
Figure 4B:
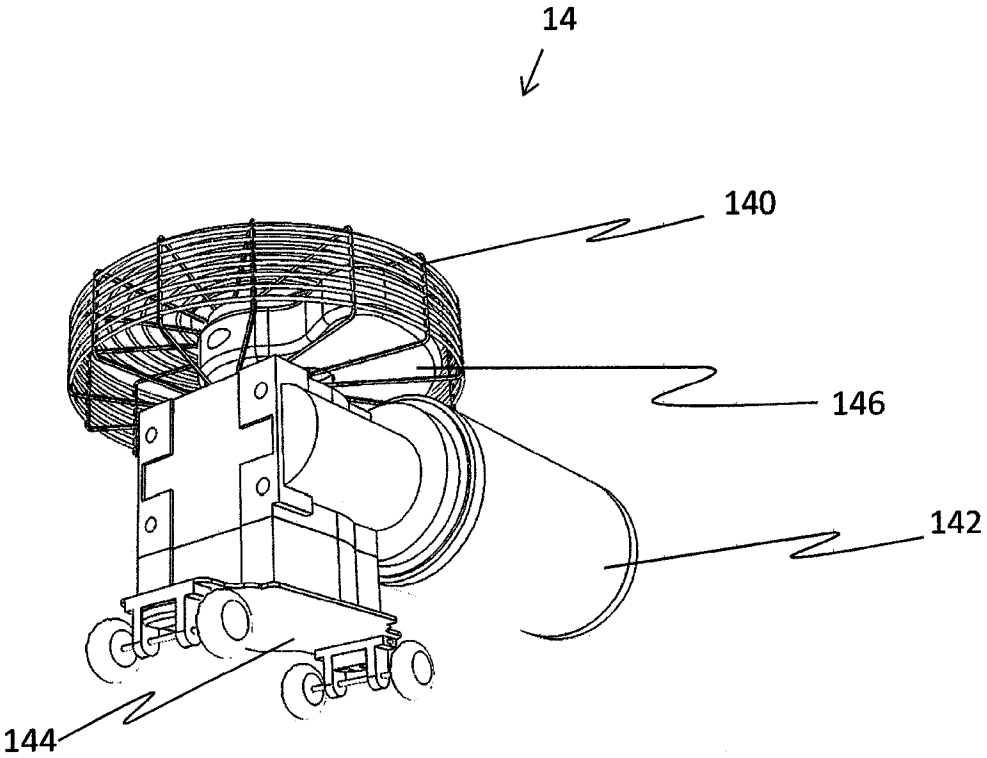
Figure 4C:
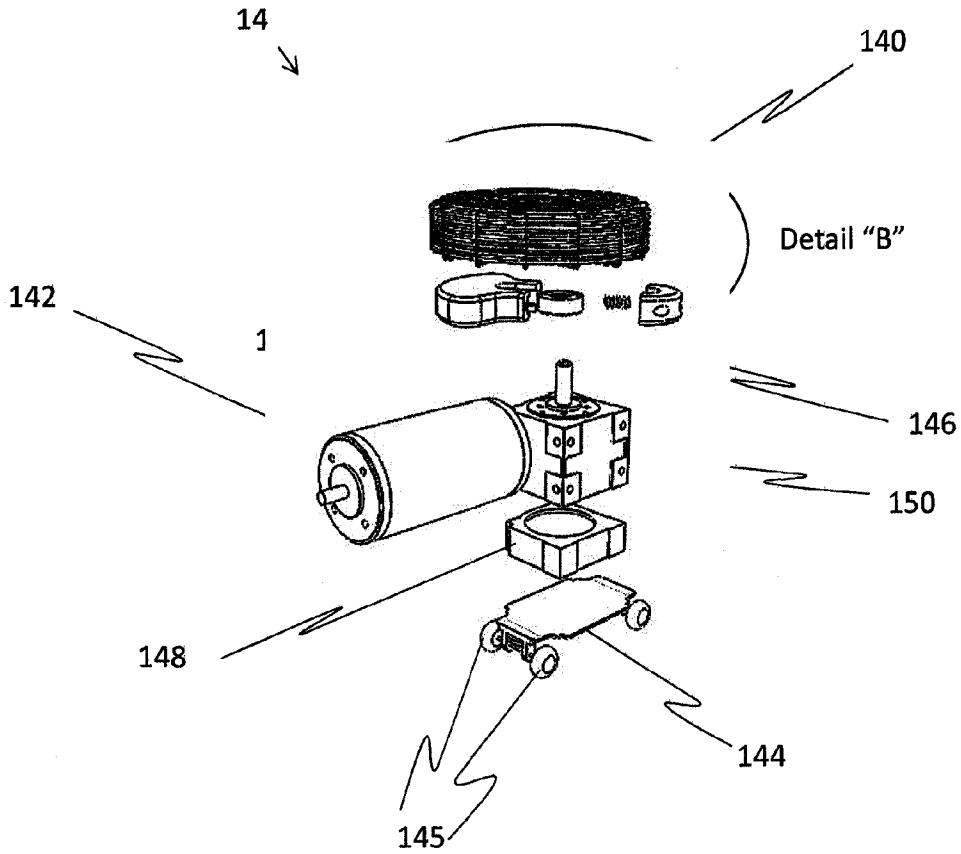
Figure 4D:
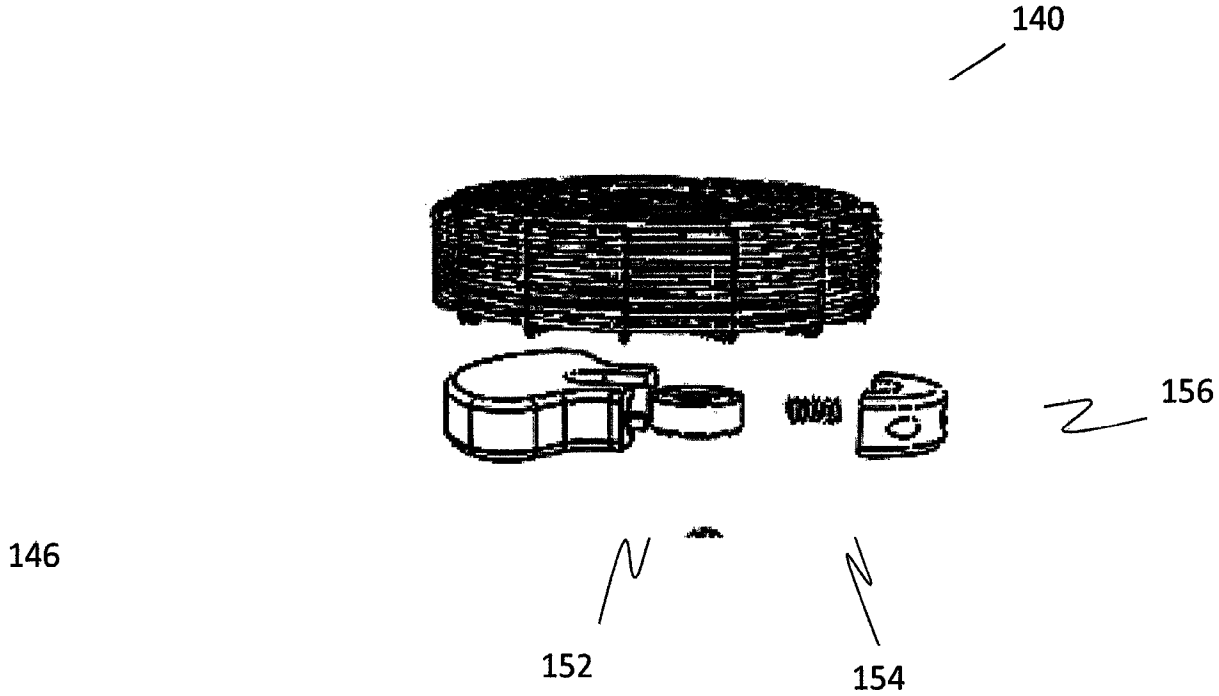

Reference is presently made to FIG. 3, which is an isometric representation of base 8 and bed vibration system 10 from FIGS. 2A and 2B, in accordance with an embodiment of the current invention. Apart from differences described below, supporting frame 11, base 8 and bed vibration system 10 are identical in notation, configuration, and functionality to that shown in FIGS. 2A and 2B, and elements indicated by the same reference numerals and/or letters are generally identical in configuration, operation, and functionality as described hereinabove. In the present figure, the positioning of ball-and-socket suspension modules 18 (shown at the four corners of base 8) and how the suspension modules may be connected to the bed are shown. "Detail A" is identified to provide further views and discussion of vibration module 14, hereinbelow.

Embodiments of the current invention include a method of retrofitting bed vibration system 10 to frame 11 to bed 5, as described hereinabove and as shown in FIGS. 2A, 2B, and 3. Retrofitting involves taking the parts of the bed vibration system as described hereinabove and mounting them onto the frame, the base, and bed. Alternatively or optionally, bed vibration system 10 may be incorporated into a new-designed bed, in which case components of the bed vibration system are modified to fit the new design, mutatis mutandis.

Reference is presently made to FIGS. 4A-D, which are isometric representations of vibration module 14, in accordance with an embodiment of the current invention. Vibration module 14 comprises: a truncated cylindrical safety mesh 140; a vibration motor 142; a rider 144 having at least 2 wheels 145; a rotatable weight 146; an attaching adapter 148; a gear box 150 having a drive shaft 151; a ball bearing assembly 152; a biasing spring 154; and a weight retention fitting 156.

FIGS. 4 B-D further show the non-symmetric, eccentric shape of rotatable weight 146. It may be understood that when rotatable weight 146 is rotated, as described hereinbelow, its eccentric shape serve to generate vibrations. Vibration module 14 operates by motor 142 driving the gear box, which in turn rotates drive shaft 151. The rotatable weight, attached to drive shaft 151 (by means of the weight retention fitting, biasing spring 154, and the ball bearing assembly—all as known in the art) is rotated at various speeds, and directions to generate vibrations of various intensities and frequencies. As a result of the vibrations generated by the variable rotation of rotatable weight 146, vibration module 14 may have vibrations and/or accelerations. Additionally, it may be seen that the structure of rider 144 allows vibration module 14 to translate along travel tracks 22 (see FIGS. 2A, 2B, and 3).

Control of speed, direction, and resultant translation and vibration (i.e. frequency and amplitude) of each of vibration modules 14 are controlled by vibration module control unit 24. Additional sensors (not shown in the figures) may be incorporated to enhance feedback and vibration afforded by bed vibration system 10.

Figure 5A:
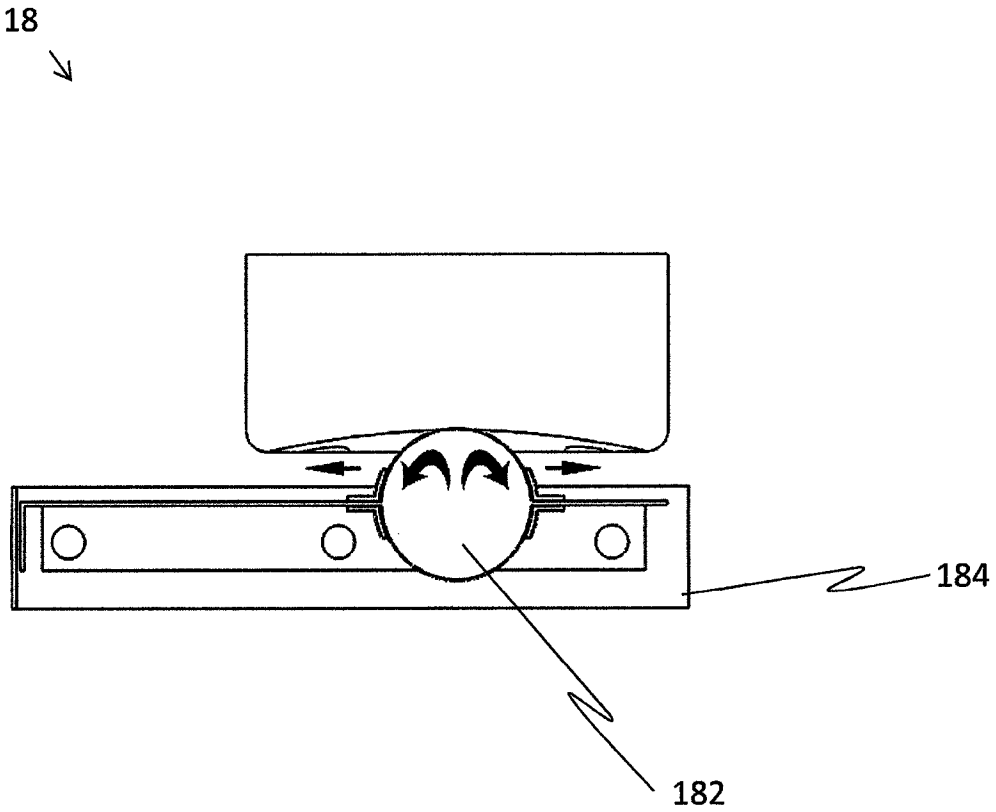
FIGS. 5A and 5B are a side orthographic projection and an isometric representation of a ball-and-socket suspension module, in accordance with an embodiment of the current invention.
Figure 5B:
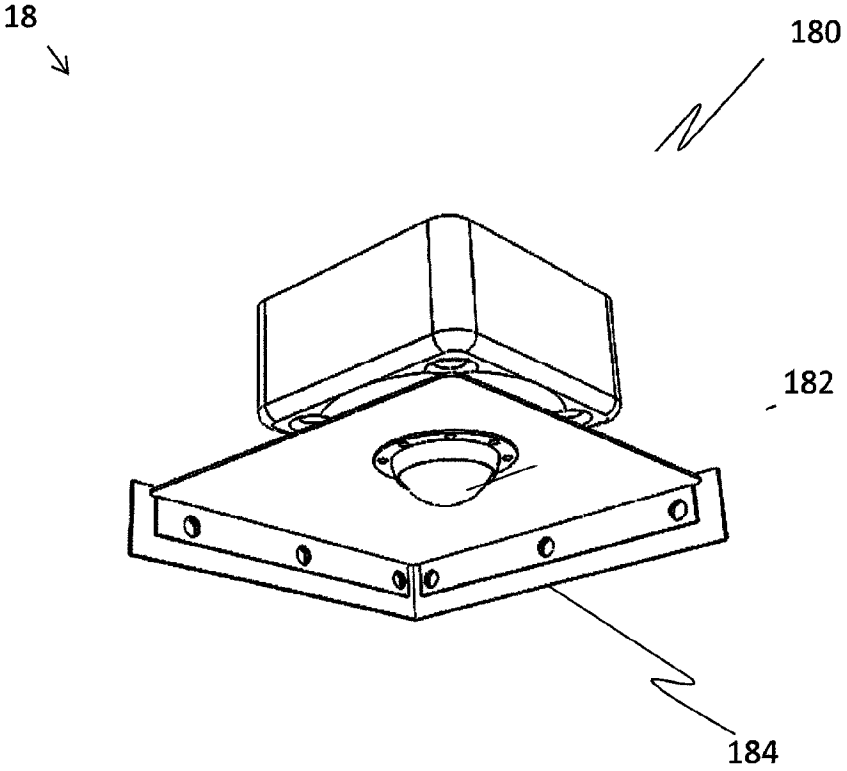

Reference is presently made to FIGS. 5A and 5B, which are a side orthographic projection and an isometric representation of ball-and-socket suspension module 18, in accordance with an embodiment of the current invention. Ball-and-socket suspension module comprises: socket member 180; rubber ball 182; and module housing 184. Socket member 180 is configured to rest upon rubber ball 182, with rubber ball being constrained/supported by module housing 184. The configuration of elements of ball-and-socket module 18 serves to dampen vibrations both in a rotational direction and a translational direction, as shown by the arrows in FIG. 5A.

It will be appreciated that the above descriptions are intended only to serve as examples, and that many other embodiments are possible within the scope of the present invention as defined in the appended claims.

The invention claimed is:

1. A bed vibration system adapted to provide controllable vibrations, and locatable on a bed beneath a mattress, the system comprising:

a frame attachable to the bed by at least four suspension modules;

at least two vibration modules, each vibration module having a rotatable element;

at least two travel tracks attachable to the frame, the travel tracks configurable to have the at least two vibration modules respectively displaceable thereupon; and a vibration module control unit configurable to control vibrations and displacement of the respective vibration modules.

2. The system of claim 1, wherein the at least two vibration modules each further comprise: a vibration motor having a shaft, a rider supporting the motor and the rider having at least two wheels mountable on the travel tracks, and a rotatable eccentric weight mountable onto the shaft.

3. The system of claim 2, wherein the vibration motor is operatable to rotate the eccentric weight.

4. The system of claim 3, wherein rotation of the eccentric weight serves to vibrate the vibration module and to provide force to displace the vibration module.

5. The system of claim 1, wherein the bed vibration system is retrofitttable to a bed.

6. The system of claim 1, wherein the suspension modules have a ball-in-socket configuration.

7. A method of retrofitting a bed vibration system on a bed beneath a mattress to provide controllable vibrations, the method comprising the steps of:

attaching a frame to the bed by at least four suspension modules;

providing at least two vibration modules, each vibration module having a rotatable element;

attaching at least two travel tracks to the frame, the travel tracks configured to have the at least two vibration modules respectively displaceable thereupon; and configuring a vibration module control unit to control vibrations and displacement of the respective vibration modules.

8. The method of claim 7, whereby the at least two vibration modules each further comprise: a vibration motor having a shaft, a rider supporting the motor and the rider having at least two wheels mounted on the travel tracks, and a rotatable eccentric weight mounted onto the shaft.

9. The method of claim 8, whereby the vibration motor is operated to rotate the eccentric weight.

10. The method of claim 9, whereby rotation of the eccentric weight serves to vibrate the vibration module and to provide force to displace the vibration module.

11. A vibration module comprising:

(a) a motor including a shaft;

(b) a rider having at least two wheels mountable on a track;

(c) a rotatable eccentric weight mounted onto the shaft; and (d) a vibration dampener with a ball and socket configuration.

12. A system comprising:

(a) at least one vibration module comprising:

a motor including a shaft;

a rider having at least two wheels mountable on a track;

a rotatable eccentric weight mounted onto the shaft; and a vibration dampener with a ball and socket configuration;

(b) a controller controlling said at least one vibration module;

(c) at least one track upon which said at least two wheels of said at least one vibration module are mounted; and (d) a mattress positioned to transmit vibrations produced by said at least one vibration module to a user reclining thereupon.

13. A system according to claim 12, wherein said controller is adapted to control translation speed of said at least one vibration module along said at least one track.

14. A system according to claim 12, wherein said controller is adapted to control translation direction of said at least one vibration module along said at least one track.

15. A system according to claim 12, wherein said controller is adapted to control vibration frequency.

16. A system according to claim 12, wherein said controller is adapted to control vibration amplitude.

17. A system according to claim 12, wherein at least one of said at least one track is mounted parallel to a long axis of said mattress.

18. A vibration module comprising:

(a) a motor including a shaft;

(b) a rider having at least two wheels mountable on a track; and (c) a single rotatable eccentric weight mounted onto the shaft.

* * * * *